US006428874B1

(12) United States Patent
McGahern et al.

(10) Patent No.: US 6,428,874 B1
(45) Date of Patent: Aug. 6, 2002

(54) GROOVED LONG NIP SHOE PRESS BELT

(75) Inventors: Desmond J. McGahern, Tumwater, WA (US); Bo-Christer Åberg, Halmstad (SE)

(73) Assignee: Albany International Corp., Albany, NY (US)

( * ) Notice: Subject to any disclaimer, the term of this patent is extended or adjusted under 35 U.S.C. 154(b) by 82 days.

(21) Appl. No.: 09/705,506

(22) Filed: Nov. 3, 2000

(51) Int. Cl.[7] ..... B32B 3/28; D21F 3/00

(52) U.S. Cl. ..... 428/167; 162/358.4; 162/901; 198/844.1

(58) Field of Search ..... 428/156, 167, 428/172; 162/358.3, 358.4, 900, 901; 474/259, 261, 262, 266; 198/846, 847, 844.1

(56) References Cited

U.S. PATENT DOCUMENTS 4,559,258 A 12/1985 Kiuchi
4,643,916 A 2/1987 Kiuchi
4,946,731 A 8/1990 Dutt
5,208,087 A * 5/1993 Stigberg ..... 428/60
5,238,537 A 8/1993 Dutt
5,360,656 A 11/1994 Rexfelt et al.
5,626,723 A * 5/1997 Schiel et al. ..... 162/358.4
5,792,323 A 8/1998 Grondahl
5,837,080 A 11/1998 Grondahl

FOREIGN PATENT DOCUMENTS

WO WO 99/49131 9/1999

* cited by examiner

*Primary Examiner*—Donald J. Loney
(74) *Attorney, Agent, or Firm*—Frommer Lawrence & Haug, LLP; Ronald R. Santucci

(57) ABSTRACT

A resin-impregnated endless belt for a long nip press of the shoe type has a base structure impregnated by a polymeric resin material which renders the belt impermeable to fluids, such as oil, water and air. The polymeric resin material forms layers on the inner and outer sides of the base structure. The inner layer is smooth, but the outer layer has primary grooves for the temporary storage of water pressed from a paper web. The primary grooves are separated by land areas which have secondary grooves extending there-across to relieve stresses which give rise to flex fatigue and stress cracking.

21 Claims, 4 Drawing Sheets

12
20
20
10
18
14
18
16

GROOVED LONG NIP SHOE PRESS BELT

BACKGROUND OF THE INVENTION

1. Field of the Invention

The present invention relates to mechanisms for extracting water from a web of material, and, more particularly, from a fibrous web being processed into a paper product on a papermaking machine. Specifically, the present invention is a resin-impregnated endless belt structure having a grooved outer surface and designed for use on a long nip press of the shoe type in any section of a papermaking or pulp dewatering machine.

2. Description of the Prior Art

During the papermaking process, a fibrous web of cellulosic fibers is formed on a forming wire by depositing a fibrous slurry thereon in the forming section of a paper machine. A large amount of water is drained from the slurry in the forming section, after which the newly formed web is conducted to a press section. The press section includes a series of press nips, in which the fibrous web is subjected to compressive forces applied to remove water therefrom. The web finally is conducted to a drying section which includes heated dryer drums around which the web is directed. The heated dryer drums reduce the water content of the web to a desirable level through evaporation to yield a paper product.

Rising energy costs have made it increasingly desirable to remove as much water as possible from the web prior to its entering the dryer section. As the dryer drums are often heated from within by steam, costs associated with steam production can be substantial, especially when a large amount of water needs to be removed from the web.

Traditionally, press sections have included a series of nips formed by pairs of adjacent cylindrical press rolls. In recent years, the use of long press nips of the shoe type has been found to be more advantageous than the use of nips formed by pairs of adjacent press rolls. This is because the web takes longer to pass through a long press nip than through one formed by press rolls. The longer the time a web can be subjected to pressure in the nip, the more water can be removed there, and, consequently, the less water will remain behind in the web for removal through evaporation in the dryer section.

The present invention relates to long nip presses of the shoe type. In this variety of long nip press, the nip is formed between a cylindrical press roll and an arcuate pressure shoe. The latter has a cylindrically concave surface having a radius of curvature close to that of the cylindrical press roll. When the roll and shoe are brought into close physical proximity to one another, a nip which can be five to ten times longer in the machine direction than one formed between two press rolls is formed. Since the long nip is five to ten times longer than that in a conventional two-roll press, the so-called dwell time of the fibrous web in the long nip is correspondingly longer under the same level of pressure per square inch in pressing force used in a two-roll press. The result of this new long nip technology has been a dramatic increase in dewatering of the fibrous web in the long nip when compared to conventional nips on paper machines.

A long nip press of the shoe type requires a special belt, such as that shown in U.S. Pat. No. 5,238,537. This belt is designed to protect the press fabric supporting, carrying and dewatering the fibrous web from the accelerated wear that would result from direct, sliding contact over the stationary pressure shoe. Such a belt must be provided with a smooth, impervious surface that rides, or slides, over the stationary shoe on a lubricating film of oil. The belt moves through the nip at roughly the same speed as the press fabric, thereby subjecting the press fabric to minimal amounts of rubbing against the surface of the belt.

Belts of the variety shown in U.S. Pat. No. 5,238,537 are made by impregnating a woven base fabric, which takes the form of an endless loop, with a synthetic polymeric resin. Preferably, the resin forms a coating of some predetermined thickness on at least the inner surface of the belt, so that the yarns from which the base fabric is woven may be protected from direct contact with the arcuate pressure shoe component of the long nip press. It is specifically this coating which must have a smooth, impervious surface to slide readily over the lubricated shoe and to prevent any of the lubricating oil from penetrating the structure of the belt to contaminate the press fabric, or fabrics, and fibrous web.

The base fabric of the belt shown in U.S. Pat. No. 5,238,537 may be woven from monofilament yarns in a single- or multi-layer weave, and is woven so as to be sufficiently open to allow the impregnating material to totally impregnate the weave. This eliminates the possibility of any voids forming in the final belt. Such voids may allow the lubrication used between the belt and shoe to pass through the belt and contaminate the press fabric or fabrics and fibrous web. The base fabric may be flat-woven, and subsequently seamed into endless form, or woven endless in tubular form.

When the impregnating material is cured to a solid condition, it is primarily bound to the base fabric by a mechanical interlock, wherein the cured impregnating material surrounds the yarns of the base fabric. In addition, there may be some chemical bonding or adhesion between the cured impregnating material and the material of the yarns of the base fabric.

Long nip press belts, such as that shown in U.S. Pat. No. 5,238,537, depending on the size requirements of the long nip presses on which they are installed, have lengths from roughly 13 to 35 feet (approximately 4 to 11 meters), measured longitudinally around their endless-loop forms, and widths from roughly 100 to 450 inches (approximately 250 to 1125 centimeters), measured transversely across those forms. It will be appreciated that the manufacture of such belts is complicated by the requirement that the base fabric be endless prior to its impregnation with a synthetic polymeric resin.

It is often desirable to provide the belt with a resin coating of some predetermined thickness on its outer surface as well as on its inner surface. By coating both sides of the belt, its woven base fabric will be closer to, if not coincident with, the neutral axis of bending of the belt. In such a circumstance, the internal stresses which arise when the belt is flexed on passing around a roll or the like on a paper machine will be less likely to cause the coating to delaminate from either side of the belt.

Moreover, when the outer surface of the belt has a resin coating of some predetermined thickness, it permits grooves, blind-drilled holes or other cavities to be formed on that surface without exposing any part of the woven base fabric. These features provide for the temporary storage of water pressed from the web in the press nip. In fact, for some long nip press configurations the presence of some void volume, provided by grooves, blind-drilled holes or the like, on the outer surface of the belt is a necessity.

The present invention relates to a long nip press belt having a plurality of grooves in the machine, or running, direction in the resin coating on the outer surface thereof. The art is replete with long nip press belts of this type. For example, U.S. Pat. No. 4,946,731 to Dutt shows such a long nip press belt, which has a base fabric which includes, in at least one of the machine and cross-machine directions, a spun yarn of staple fibers. When the base fabric is coated with a polymeric resin material, individual staple fibers extend from the spun yarns outward into the surrounding coating material. Subsequently, machine-direction grooves are cut into the coating on the outer surface of the belt. The so-called land areas separating the grooves from one another are anchored to the belt by these staple fibers, which make them less susceptible to delamination.

In addition to being susceptible to delamination, the land areas are also susceptible to flex fatigue, because they are repeatedly flexed convexly, when entering and exiting a long press nip, and concavely, when passing through the nip. Once flex fatigue sets in, the land areas develop stress cracks in the cross-machine direction. Once stress cracks appear, the land areas begin to deteriorate through the loss of portions which break away at the crack sites. Ultimately, this leads to a loss of void volume for the belt. Unfortunately, then, the formation of stress cracks signals the approach of the end of the useful life of the belt on the paper machine.

The present invention provides a solution to this problem by incorporating a means for reducing and relieving the stresses which result in flex fatigue, thereby delaying the formation of stress cracks and, consequently, prolonging the useful life of the belt.

SUMMARY OF THE INVENTION

Accordingly, the present invention is a resin-impregnated endless belt for a long nip press of the shoe type. The belt comprises a base structure which is in the form of an endless loop. As such the base structure has an outer side, an inner side, a longitudinal direction around the endless loop, and a transverse direction across the endless loop.

A polymeric resin material impregnates the base structure and renders it impermeable to fluids, such as oil, water and air. The polymeric resin material forms an inner layer on the inner side of the base structure, the inner layer providing an inner surface for the belt. The inner surface of the belt is smooth.

The polymeric resin material also forms an outer layer on the outer side of the base fabric structure. The outer layer provides the belt with an outer surface. The outer layer has a plurality of primary grooves and a plurality of land areas, each of the primary grooves being separated from those adjacent thereto by a land area. The land areas each have a plurality of secondary grooves extending thereacross. The secondary grooves have a depth and a width less than those of the primary grooves, and are the means by which stresses which otherwise lead to flex fatigue are reduced and relieved.

The present invention will now be described in more complete detail with frequent reference being made to the drawings identified below.

DETAILED DESCRIPTION OF THE PREFERRED EMBODIMENT

Figure 1:
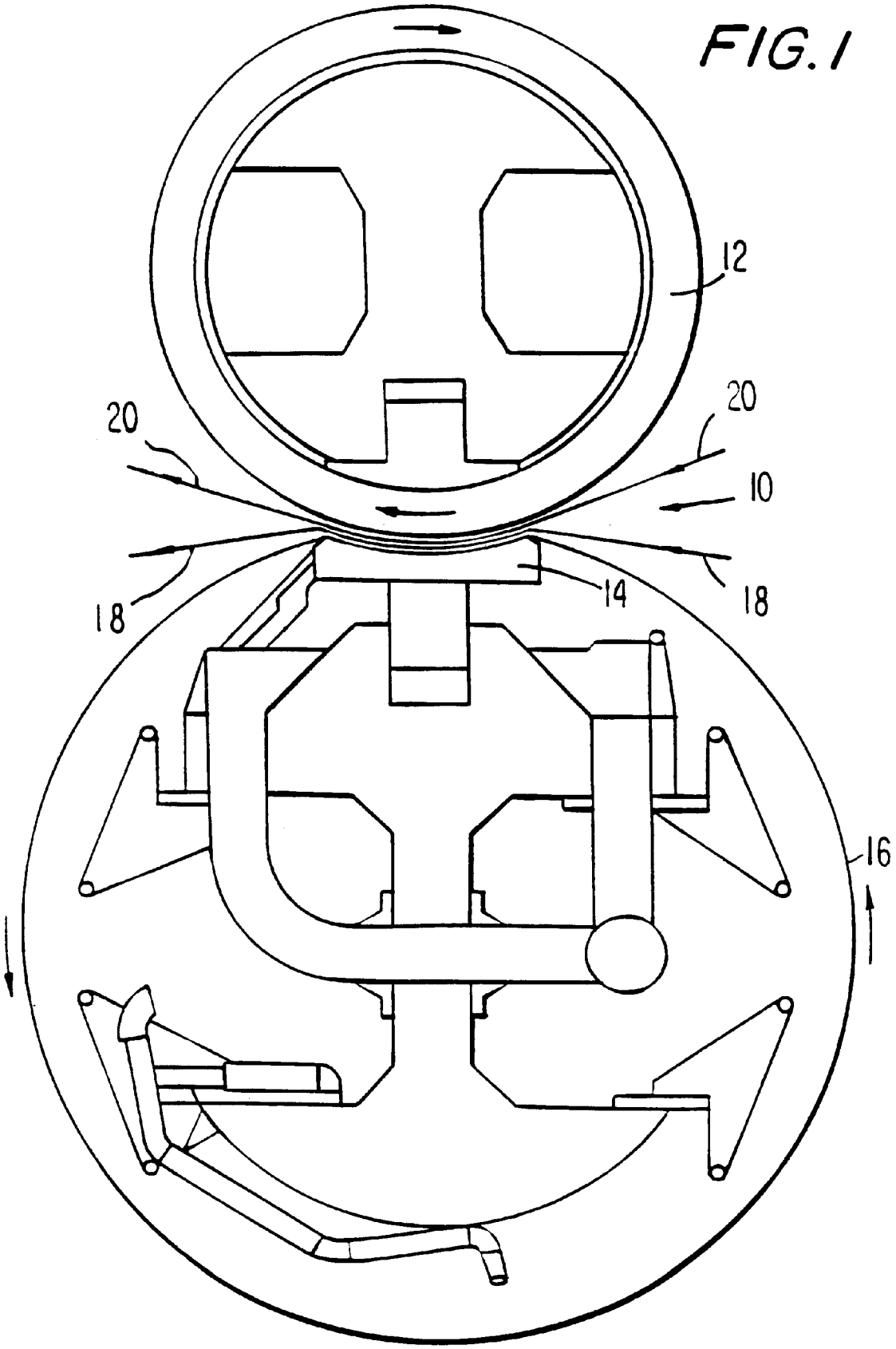
FIG. 1 is a side cross-sectional view of a long nip press.

A long nip press for dewatering a fibrous web being processed into a paper product on a paper machine is shown in a side cross-sectional view in FIG. 1. The press nip 10 is defined by a smooth cylindrical press roll 12 and an arcuate pressure shoe 14. The arcuate pressure shoe 14 has about the same radius of curvature as the cylindrical press roll 12. The distance between the cylindrical press roll 12 and the arcuate pressure shoe 14 may be adjusted by hydraulic means operatively attached to arcuate pressure shoe 14 to control the loading of the nip 10. Smooth cylindrical press roll 12 may be a controlled crown roll matched to the arcuate pressure shoe 14 to obtain a level cross-machine nip pressure profile.

Long nip press belt 16 extends in a closed loop through nip 10, separating cylindrical press roll 12 from arcuate pressure shoe 14. A press fabric 18 and a fibrous web 20 being processed into a paper sheet pass together through nip 10 as indicated by the arrows in FIG. 1. Fibrous web 20 is supported by press fabric 18 and comes into direct contact with smooth cylindrical press roll 12 in nip 10. Alternatively, fibrous web 20 may pass through nip 10 sandwiched between two press fabrics 18. As shown in FIG. 1, fibrous web 20 and press fabric 18 proceed through the nip 10 as indicated by the arrows. Long nip press belt 16, also moving through press nip 10 as indicated by arrows, that is, counterclockwise as depicted in FIG. 1, protects press fabric 18 from direct sliding contact against arcuate pressure shoe 14, and slides thereover on a lubricating film of oil. Long nip press belt 16, accordingly, must be impermeable to oil, so that press fabric 18 and fibrous web 20 will not be contaminated thereby.

Figure 2:
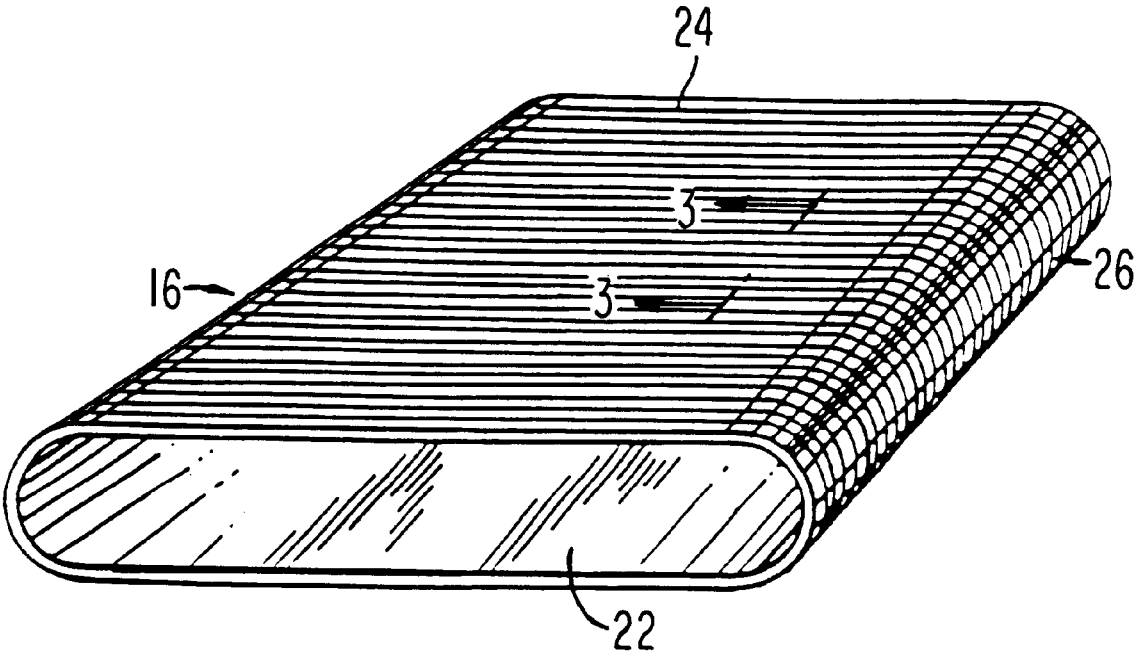
FIG. 2 is a perspective view of a long nip press belt.

A perspective view of the long nip press belt 16 is provided in FIG. 2. The belt 16 has an inner surface 22 and an outer surface 24. The outer surface 24 is provided with a plurality of primary grooves 26 extending in the machine direction around the belt 16 for the temporary storage of water pressed from fibrous web 20 in press nip 10.

Figure 3:
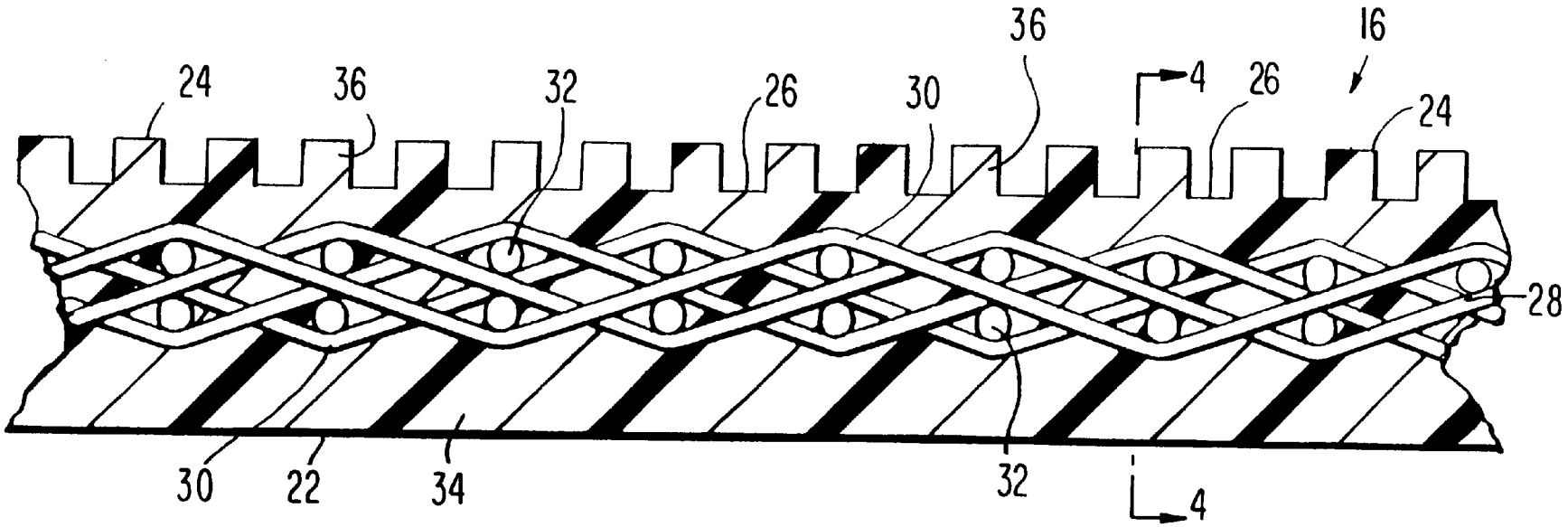
FIG. 3 is a cross-sectional view taken as indicated by line 3—3 in FIG. 2.

FIG. 3 is a cross section of belt 16 taken as indicated by line 3—3 in FIG. 2. The cross section is taken in the transverse, or cross-machine, direction of belt 16, and shows that belt 16 includes a base structure 28. The base structure 28 is woven from transverse, or cross-machine direction, yarns 30, viewed from the side in FIG. 3, and longitudinal, or machine-direction, yarns 32, seen in cross section in FIG. 3. Base structure 28 is depicted as having been woven endless, the transverse yarns 30 being warp yarns weaving over, under and between the stacked pairs of longitudinal yarns 32, the weft yarns in the endless weaving process, in a duplex weave. It should be understood, however, that base structure 28 may be flat woven, and subsequently joined into endless form with a seam. It should be further understood that base structure 28 may be woven in a single-layer weave, or in any other weave which may be used in the production of paper machine clothing.

The base structure 28 may alternatively be a nonwoven structure in the form of an assembly of transverse and longitudinal yarns, which may be bonded together at their mutual crossing points to form a fabric. Further, the base structure 28 may be a knitted or braided fabric, or a spiral-link belt of the type shown in U.S. Pat. No. 4,567,077 to Gauthier, the teachings of which are incorporated herein by reference. The base structure 28 may also be extruded from a polymeric resin material in the form of a sheet or membrane, which may subsequently be provided with apertures. Alternatively still, the base structure 28 may comprise nonwoven mesh fabrics, such as those shown in commonly assigned U.S. Pat. No. 4,427,734 to Johnson, the teachings of which are incorporated herein by reference.

Further, the base structure 28 may be produced by spirally winding a strip of woven, nonwoven, knitted, braided, extruded or nonwoven mesh material according to the methods shown in commonly assigned U.S. Pat. No. 5,360,656 to Rexfelt et al., the teachings of which are incorporated herein by reference. The base structure 28 may accordingly comprise a spirally wound strip, wherein each spiral turn is joined to the next by a continuous seam making the base structure 28 endless in a longitudinal direction. A press belt having a base structure of this type is disclosed in commonly assigned U.S. Pat. Nos. 5,792,323 and 5,837,080, the teachings of which are incorporated herein by reference.

The inner surface 22 of belt 16, that is, the surface which slides over the arcuate pressure shoe 14 when belt 16 is in use on a long nip press, is formed by a polymeric resin coating 34. The polymeric resin also impregnates the base structure 28, and renders the belt 16 impermeable to oil and water. The polymeric resin coating 34 may be of polyurethane, and preferably is a 100% solids composition thereof. The use of a 100% solids resin system, which by definition lacks a solvent material, enables one to avoid the formation of bubbles in the polymeric resin during the curing process through which it proceeds following its application onto base fabric 28.

The outer surface 24 of belt 16, that is, the surface which contacts press fabric 18 when belt 16 is in use on a long nip press, is also formed by polymeric resin coating 34.

The inner surface 22 and the outer surface 24 may be ground and buffed after the polymeric resin has been cured to provide the polymeric resin coating 34 with a smooth, uniform surface.

After the polymeric resin has been cured, the primary grooves 26 may be cut into the outer surface 24 of the belt 16. Alternatively, the primary grooves 26 may be pressed into the outer surface 24 by an embossing device before the polymeric resin has been cured, or may be molded into the outer surface 24 where the belt 16 is manufactured using a molding process.

Primary grooves 26 are separated from one another by so-called land areas 36. Primary grooves 26 and land areas 36 are depicted in FIG. 3 as being of equivalent width, although this need not be the case. Nevertheless, the land areas 36 may be thought of as narrow pillars of cured polymeric resin aligned in the machine direction on the outer surface 24 of the belt 16.

As previously observed, the presence of polymeric resin coating 34 places the neutral axis of bending of the belt 16 closer to, if not coincident with, the base structure 28. Because the land areas 36 extend farther from the base structure 28 than the floors of the primary grooves 26, and because they are narrow pillars of cured polymeric resin, they are particularly vulnerable to flex fatigue which develops as they are repeatedly placed under tension, when passing convexly over the entrance and exit of the press nip 10, and under compression, when passing concavely over the arcuate pressure shoe 14. Inevitably, the flex fatigue causes stress cracks to appear in the cross-machine direction across the land areas 36.

Figure 4:
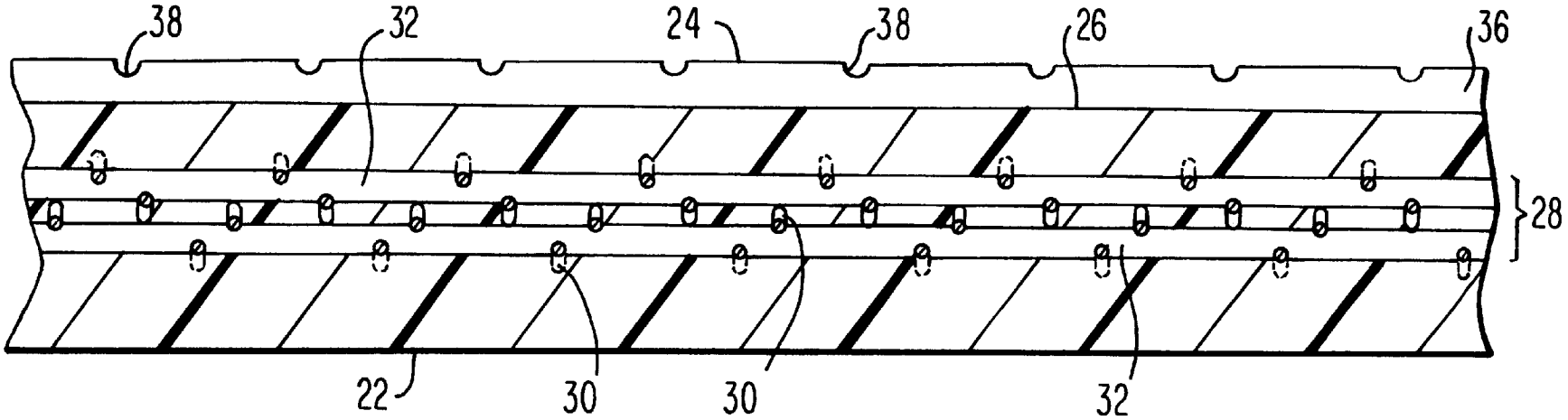
FIG. 4 is a cross-sectional view taken as indicated by line 4—4 in FIG. 3.

The present invention provides a means for reducing this flex fatigue and the consequent appearance of stress cracks. FIG. 4 is a cross section of belt 16 taken as indicated by line 4—4 in FIG. 3. This cross section is taken in the longitudinal, or machine, direction of the belt 16 through the bottom of one of the primary grooves 26, and shows one of the land areas 36 from the side. Further, FIG. 4 shows the longitudinal, or machine-direction, yarns 32 from the side, and the transverse, or cross-machine-direction, yarns 30 in cross section.

In accordance with the present invention, land areas 36 are provided with secondary grooves 38 extending in the transverse direction thereacross. Secondary grooves 38 may have U-shaped cross sections, as shown in FIG. 4, and have a depth and a width less than those of primary grooves 26. The shape, dimensions, spacing and orientation of the secondary grooves 38 are determined having regard to the long nip press on which the belt 16 is to be used, their primary function being to relieve land area stress, which otherwise leads to flex fatigue and land area cracking and failure. The width of the individual secondary grooves 38 must be sufficiently large for them not to close when the belt 16 is flexed concavely in passing along an arcuate pressure shoe 14; otherwise, the secondary grooves 38 would tend to pinch press fabric 18 in the press nip 10.

As was the case with the primary grooves 26, the secondary grooves 38 may be cut into the outer surface 24 of the belt 16 after the polymeric resin has been cured. Alternatively, the secondary grooves 38 may be pressed into the outer surface 24 by an embossing device before the polymeric resin has been cured, or may be molded into the outer surface 24 where the belt is manufactured using a molding process.

It should be understood that the primary grooves 26 may be provided in one manner, while the secondary grooves 38 are provided in another manner. For example, the secondary grooves 38 may be pressed into the outer surface 24 by an embossing device before the polymeric resin has been cured. Then, after the polymeric resin has been cured, the primary grooves 26 may be cut into the outer surface 24 of the belt 16 with rotating slitters. Other possibilities would readily become apparent to those of ordinary skill in the art.

Although the primary grooves 26 have been described in the preceding discussion as being oriented in the machine, or longitudinal, direction, and the secondary grooves 38 as being oriented in the cross-machine, or transverse, direction, some departure from such precise alignments is within the scope of the present invention.

For example, primary grooves 26 may indeed be provided by cutting a continuous single groove which spirals about the endless loop of the belt 16 on outer surface 24. In such a situation, the orientation of the resulting primary grooves 26 deviates from the machine, or longitudinal, direction by a small angle. However, the provision of primary grooves 26 in this manner is contemplated by the inventors as falling within the scope of their invention, so long as the orientation of the primary grooves 26 is primarily in the machine, or longitudinal, direction by deviating no more than 45° therefrom at any point.

Moreover, primary grooves 26 may alternatively be provided by cutting two continuous single grooves which spiral about the endless loop of the belt 16 on outer surface 24 in opposite directions, that is, one describing a right-handed spiral and the other describing a left-handed spiral. Further, primary grooves 26 need not be perfectly straight, but may have some degree of curvature or waviness so long as they remain primarily oriented in the machine, or longitudinal, direction by deviating no more than 45° therefrom at any point. By the same token, the orientation of the secondary grooves 38 may deviate from the cross-machine, or transverse, direction by a small angle without departing from the scope of the present invention. That is to say, the orientation of the secondary grooves 38 is primarily in the cross-machine, or transverse, direction by deviating no more than 45° therefrom. Moreover, the secondary grooves 38, too, need not be perfectly straight, but may have some degree of curvature or waviness so long as they remain primarily oriented in the cross-machine, or transverse, direction by deviating no more than 45° therefrom.

The secondary grooves 38 have been found to significantly reduce the stresses on the land areas 36 during the operation of belt 16 on a long nip press, delaying the onset of flex fatigue and, accordingly, prolonging the useful life of belt 16 on the long nip press.

In a long nip press belt 16 of the present invention, the primary grooves 26 may have a depth of approximately 1.5 mm, and a width in the range from 0.5 mm to 2.0 mm. Each primary groove 26 may be separated from the next by a distance (land width) in the range from 1.0 mm to 2.5 mm. The depth and width of the secondary grooves 38 are less than those of the primary grooves 26, although the width should be no less than 0.1 mm to avoid possible removal of batt fiber from the surface of a press fabric in contact with the belt 16 by a pinching action when the belt 16 is flexed in a press nip. The distance separating the secondary grooves 38 is chosen separately from that separating the primary grooves 26, and is typically greater than that separating the primary grooves 26.

Modifications to the above would be obvious to those of ordinary skill in the art, but would not bring the invention so modified beyond the scope of the appended claims.

What is claimed is:

1. A resin-coated endless belt for a long nip press of the shoe type, said resin-impregnated endless belt comprising:

a base structure, said base structure being in the form of an endless loop and having an outer side, an inner side, a longitudinal direction, said longitudinal direction being around said endless loop, and a transverse direction, said transverse direction being across said endless loop; and a polymeric resin material impregnating said base structure and rendering said base structure impermeable to fluids; said polymeric resin material forming an inner layer on said inner side of said base structure, said inner layer providing an inner surface for said belt, said inner surface being smooth; and said polymeric resin material further forming an outer layer on said outer side of said base structure, said outer layer providing an outer surface for said belt, said outer layer further having a plurality of primary grooves and a plurality of land areas, said primary grooves being primarily oriented in said longitudinal direction, each of said primary grooves being separated from those adjacent thereto by a land area, said land areas each having a plurality of secondary grooves extending thereacross, said secondary grooves having a depth and a width less than those of said primary grooves and being primarily oriented in said transverse direction.

2. A resin-impregnated endless belt as claimed in claim 1 wherein said primary grooves are straight and oriented exactly in said longitudinal direction.

3. A resin-impregnated endless belt as claimed in claim 1 wherein said secondary grooves are straight and oriented exactly in said transverse direction.

4. A resin-impregnated endless belt as claimed in claim 1 wherein said primary grooves are straight and oriented at an angle less that 45° from the longitudinal direction.

5. A resin-impregnated endless belt as claimed in claim 1 wherein said secondary grooves are straight and oriented at an angle less than 45° from the transverse direction.

6. A resin-impregnated endless belt as claimed in claim 1 wherein said primary grooves are curved, and wherein no portion of said primary grooves deviates in orientation from said longitudinal direction by more than 45°.

7. A resin-impregnated endless belt as claimed in claim 1 wherein said secondary grooves are curved, and wherein no portion of said secondary grooves deviates in orientation from said transverse direction by more than 45°.

8. A resin-impregnated endless belt as claimed in claim 1 wherein said primary grooves are a continuous single groove spiralling on said outer surface thereof.

9. A resin-impregnated endless belt as claimed in claim 1 wherein said primary grooves are two continuous single grooves spiralling on said outer surface thereof, one describing a right-handed spiral and the other describing a left-handed spiral.

10. A resin-impregnated endless belt as claimed in claim 1 wherein said secondary grooves have a U-shaped cross section.

11. A resin-impregnated endless belt as claimed in claim 1 wherein said inner and outer surfaces of said belt are ground and buffed.

12. A resin-impregnated endless belt as claimed in claim 1 wherein said base structure is a woven fabric.

13. A resin-impregnated endless belt as claimed in claim 1 wherein said base structure is a nonwoven structure in the form of an assembly of transverse and longitudinal yarns.

14. A resin-impregnated endless belt as claimed in claim 13 wherein said transverse and longitudinal yarns are bonded to one another at their mutual crossing points to form a nonwoven fabric.

15. A resin-impregnated endless belt as claimed in claim 1 wherein said base structure is a knitted fabric.

16. A resin-impregnated endless belt as claimed in claim 1 wherein said base structure is a braided fabric.

17. A resin-impregnated endless belt as claimed in claim 1 wherein said base structure is an extruded sheet of a polymeric resin material.

18. A resin-impregnated endless belt as claimed in claim 1 wherein said base structure is a nonwoven mesh fabric.

19. A resin-impregnated belt as claimed in claim 1 wherein said base structure is a spiral-link belt.

20. A resin-impregnated endless belt as claimed in claim 1 wherein said base structure is a strip of material spirally wound in a plurality of turns, each turn being joined to those adjacent thereto by a continuous seam, said base structure being endless in a longitudinal direction, said strip material being selected from the group consisting of woven fabrics, nonwoven fabrics, knitted fabrics, braided fabrics, extruded sheets of polymeric material and nonwoven mesh fabrics.

21. A resin-impregnated endless belt as claimed in claim 1 wherein said polymeric resin material is polyurethane.

* * * * *